US007913729B2

(12) United States Patent
Brcich

(10) Patent No.: US 7,913,729 B2
(45) Date of Patent: Mar. 29, 2011

(54) MOLDING COPING FIXTURE

(76) Inventor: Anthony Brcich, Arlington Heights, IL (US)

( * ) Notice: Subject to any disclaimer, the term of this patent is extended or adjusted under 35 U.S.C. 154(b) by 247 days.

(21) Appl. No.: 11/562,305

(22) Filed: Nov. 21, 2006

(65) Prior Publication Data

US 2007/0164469 A1 Jul. 19, 2007

Related U.S. Application Data

(60) Provisional application No. 60/597,308, filed on Nov. 22, 2005.

(51) Int. Cl.
*B27C 5/00* (2006.01)

(52) U.S. Cl. ..... 144/134.1; 144/2.1; 144/144.1; 269/266

(58) Field of Classification Search ..... 144/134.1, 144/135.2, 136.95, 144.1, 144.51, 145.1, 144/1.1, 2.1, 3.1; 269/266–270
See application file for complete search history.

(56) References Cited

U.S. PATENT DOCUMENTS

| | | | | | |
|---|---|---|---|---|---|
| 470,794 | A | | 3/1892 | Shempp | |
| 567,905 | A | | 9/1896 | Locke | |
| 753,251 | A | | 3/1904 | Ekvall | |
| 1,062,214 | A | | 5/1913 | Bergman | |
| 1,570,177 | A | | 1/1926 | Pointer | |
| 2,631,375 | A | * | 3/1953 | Gleason | 33/25.1 |
| 2,735,456 | A | | 2/1956 | Grier et al. | |
| 3,301,287 | A | * | 1/1967 | Edwards | 144/144.1 |
| 3,442,309 | A | | 5/1969 | Jentsch | |
| 3,644,041 | A | * | 2/1972 | Haus | 355/122 |
| 3,739,824 | A | * | 6/1973 | Hoenig | 144/144.1 |
| 3,865,162 | A | | 2/1975 | Schmidt | |
| 4,221,052 | A | * | 9/1980 | Wagoner | 33/25.2 |
| 4,249,446 | A | | 2/1981 | Tallerico, Jr. | |
| 4,355,557 | A | | 10/1982 | Mecsey | |
| 4,356,849 | A | | 11/1982 | Fredrickson | |
| 4,554,740 | A | * | 11/1985 | Gill | 33/25.1 |
| 4,743,004 | A | | 5/1988 | Kloss | |
| 4,871,002 | A | | 10/1989 | Turner | |
| 4,880,042 | A | | 11/1989 | Schafferkotter | |
| 5,094,279 | A | | 3/1992 | Dickey et al. | |
| 5,136,904 | A | | 8/1992 | Peters | |
| 5,168,635 | A | * | 12/1992 | Hoffman | 33/561.1 |
| 5,363,732 | A | | 11/1994 | Heasley | |

(Continued)

OTHER PUBLICATIONS

"Copemaster" online product description; date unknown, as least as early as Nov. 7, 2005.

(Continued)

*Primary Examiner* — Shelley Self
(74) *Attorney, Agent, or Firm* — Law Office of Marc D. Machtinger, Ltd.

(57) ABSTRACT

A molding coping fixture is disclosed. The coping fixture includes a plurality of shims, where the shims can be adjusted to conform to a profile of a molding to be coped, the shims are secured into the fixture and maintain the profile during a coping cut by a router. The coping fixture according to the present invention also includes an anti-tear-out device prevent tear-out of material from the molding during the coping cut. In various preferred embodiments, some or all of the anti-tear-out device may be replaceable. The coping fixture according to the present invention also includes a fixture for selectively adjusting the angle of the coping cut. In various preferred embodiments, a guide pin passes along the shims and a router bit secured in a fixed relation to the guide pin performs the coping cut while the guide pin passes along the shims.

7 Claims, 15 Drawing Sheets

U.S. PATENT DOCUMENTS

| | | | | |
|---|---|---|---|---|
| 5,388,334 | A | 2/1995 | Halsey | |
| 5,546,784 | A * | 8/1996 | Haas et al. | 72/413 |
| 5,667,001 | A | 9/1997 | Sanger et al. | |
| 5,778,951 | A | 7/1998 | Huitsing | |
| 5,819,420 | A | 10/1998 | Collins | |
| 5,853,036 | A | 12/1998 | Welch | |
| 5,893,402 | A | 4/1999 | Darling | |
| 6,006,641 | A | 12/1999 | Fletcher | |
| 6,086,462 | A | 7/2000 | Brown | |
| 6,095,726 | A | 8/2000 | Scott et al. | |
| 6,152,009 | A | 11/2000 | Jorgensen et al. | |
| 6,367,524 | B1 * | 4/2002 | Brewer | 144/371 |
| 6,374,879 | B1 | 4/2002 | Lukehart | |
| 6,422,117 | B1 | 7/2002 | Burch | |
| 6,450,220 | B2 | 9/2002 | Domask | |
| 7,131,470 | B1 * | 11/2006 | Sommers | 144/286.5 |
| 7,131,473 | B1 * | 11/2006 | Brewer | 144/371 |
| 7,703,190 | B2 * | 4/2010 | Halford | 29/557 |
| 2001/0035231 | A1 | 11/2001 | Domask | |
| 2003/0190202 | A1 | 10/2003 | Scott et al. | |
| 2005/0109181 | A1 | 5/2005 | Zawadzki et al. | |

OTHER PUBLICATIONS

"On The Job" router accessory article. May 2004.

* cited by examiner

MOLDING COPING FIXTURE

CROSS-REFERENCE TO RELATED APPLICATION

This application claims the benefit of U.S. Provisional Application No. 60/597,308, filed on Nov. 22, 2005, which is hereby incorporated by reference in its entirety.

FIELD OF THE INVENTION

The present invention relates to fitting of moldings, and more specifically to a coping cuts made to fit moldings together at inside corners, and even more specifically to a fixture for making coping cuts in moldings.

DESCRIPTION OF THE RELATED ART

Coping the inside corner of molding, such as baseboard moldings, chair rails, quarter round, and the like, entails cutting the profile of the molding into the end grain of one of the moldings. This cutting process in known as coping. The piece that receives the cut, the coped piece, helps push and hold the adjoining piece against the wall and into the corner when the pieces are installed. The result is a well fit corner that will not be affected by expansion and contraction of the wood.

Traditionally, coping cuts are made by hand. To accurately make coping cuts, a skilled woodworker is required, as these cuts require a fairly high skill level. In most cases, this skill level is beyond the "do-it-yourselfer".

Some attempts to simplify or mechanize the process of making coping cuts have been made. One product currently commercially available is called the "COPEMASTER". This large and expensive device works in a manner similar to key cutting and duplicating machines. First, a template is made on the machine by moving a carriage having a specially designed circular saw blade in a particular direction. This template is then locked into a vice, where a stylus traces the template and the saw cuts a molding based on the movement of the stylus against the template. There are several drawbacks to the "COPEMASTER" device. This device is a large, expensive, stand alone power tool. The size and weight of the COPEMASTER makes it inconvenient for use portable use, such as at a job site. Because the COPEMASTER has its own custom designed saw blade and saw motor to go along with the carriage assembly and stylus, the COPEMASTER is priced out of the range of the typical home project hobbyist.

Another tool designed to assist in making coping cuts is called "THE COPER". To use this device, a user must first create a template from a piece of the molding to be coped. The template is created from a two part epoxy mixture by placing a piece of the molding into a tray and then casting the profile of the molding into the epoxy. Before use, the template must be allowed to fully harden, which can take several hours. Once hardened, the template is fastened into a clamping jig and used to guide a router bit along the end of the molding to be coped. Because of the time needed to create the template, "THE COPER" is inconvenient for coping moldings of different types, such as base molding and quarter-round, as part of one project.

Neither of the devices mentioned above effectively prevent "tear-out" of wood or material in the molding being coped. "Tear-out" is the peeling, tearing, or splitting out of wood fibers from the molding being coped. Tear-outs occur most often at the end of the cut, which typically is the top and most visible portion of the molding. Tear-out can lead to unsightly blemishes in the molding.

In view of the deficiencies cited above, there remains a need for an improved coping fixture. Thus, it would be advantageous to provide a coping fixture that is versatile, easy to use, portable, and reduces or eliminates tear-outs.

SUMMARY

It is an object of the present invention to provide an improved coping fixture.

It is a further object of the present invention to provide a coping fixture that is versatile, easy to use, portable, and reduces the occurrence of tear-outs It is a further objective of the present invention to provide a coping fixture where a user can select the desired angle of said coping cut.

The present invention is a molding coping fixture. According to the present invention, the coping fixture includes a plurality of shims, where the shims can be adjusted to conform to a profile of a molding to be coped, the shims are secured into the fixture and maintain the profile during a coping cut by a router. The coping fixture according to the present invention also includes an anti-tear-out device to prevent tear-out of material from the molding during the coping cut. In various preferred embodiments, some or all of the anti-tear-out device may be replaceable. The coping fixture according to the present invention also includes a fixture for selectively adjusting the angle of the coping cut. In various preferred embodiments, a guide pin passes along the shims and a router bit secured in a fixed relation to the guide pin performs the coping cut while the guide pin passes along the shims.

Other features and advantages of the invention will be apparent from the following detailed description taken in conjunction with the following figures, wherein like reference numerals represent like features.

DETAILED DESCRIPTION OF THE INVENTION

Figure 1A:
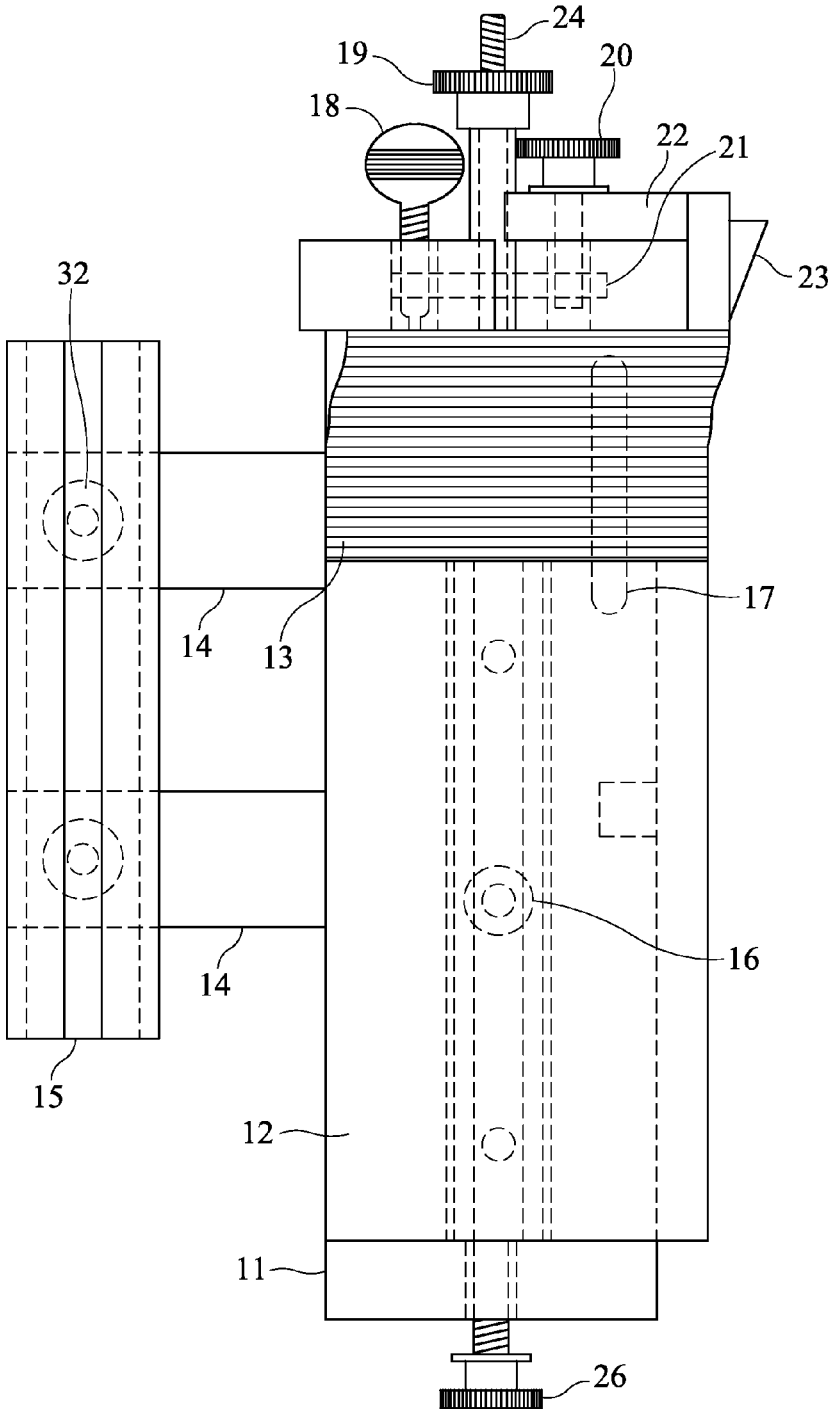
FIG. 1A shows a top view of a coping fixture according to the present invention.
Figure 1B:
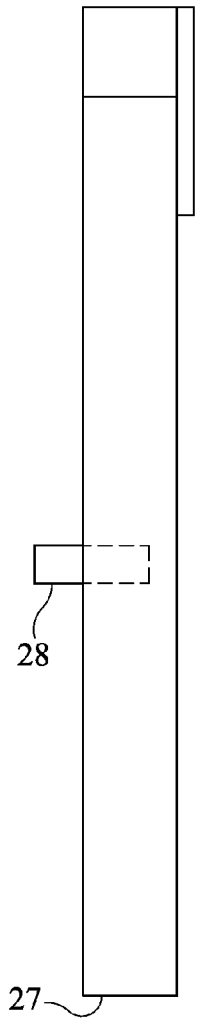
FIG. 1B shows another view of an aspect of the coping fixture of according to the present invention.

While this invention is susceptible of embodiments in many different forms, there are shown in the drawings and will herein be described in detail, preferred embodiments of the invention with the understanding that the present disclosure is to be considered as an exemplification of the principles of the invention and is not intended to limit the broad aspect of the invention to the embodiments illustrated.

Figure 2:
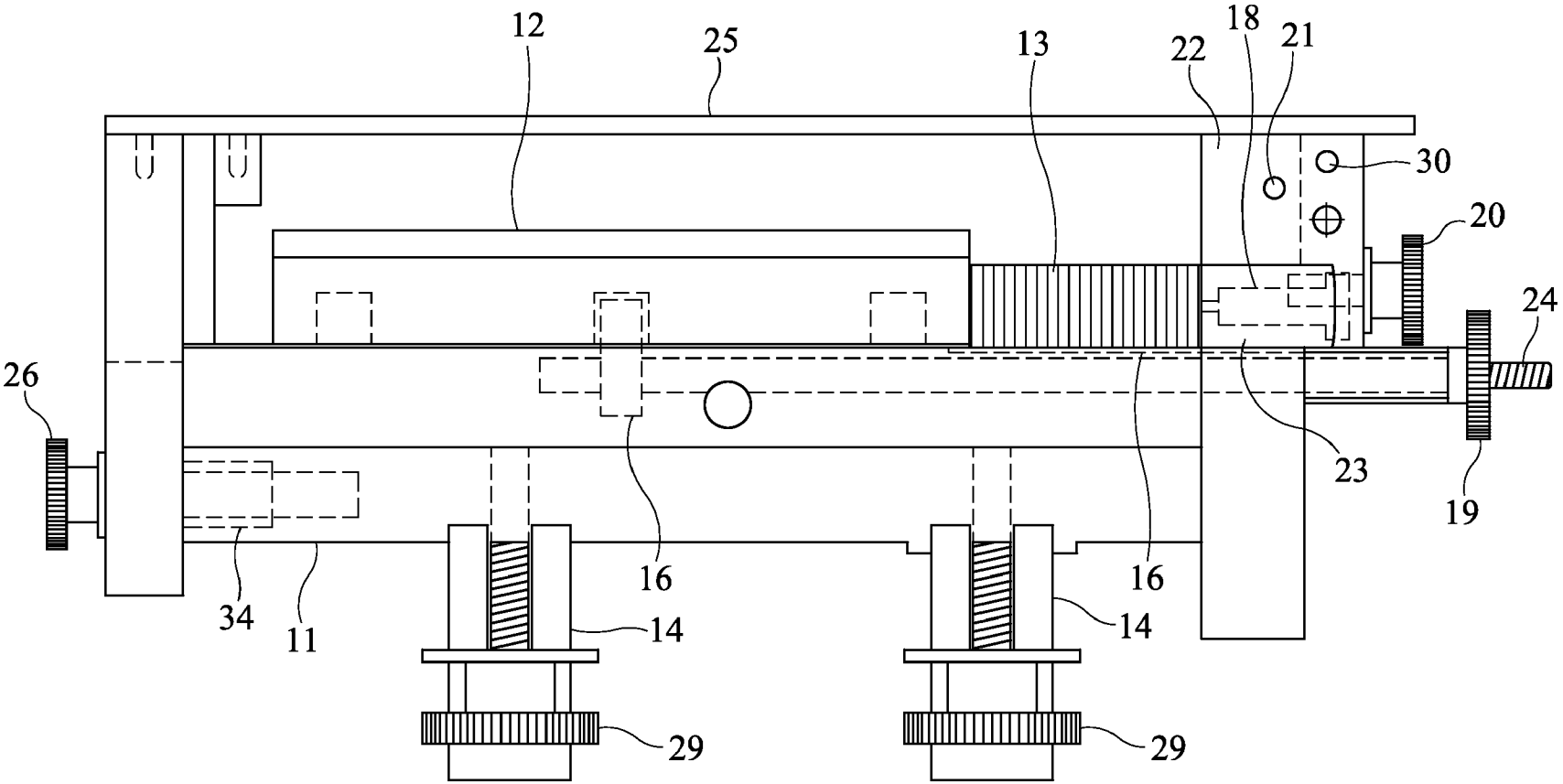
FIG. 2 shows a side view of a coping fixture according to the present invention.
Figure 3C:
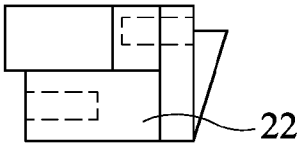
FIG. 3C shows another view of an aspect of the coping fixture of according to the present invention.
Figure 3D:
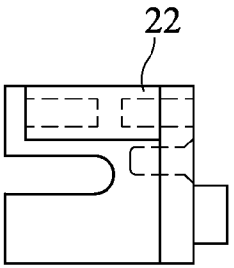
FIG. 3D shows another view of an aspect of the coping fixture of according to the present invention.
Figure 3E:
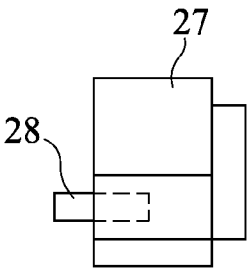
FIG. 3E shows another view of an aspect of the coping fixture of according to the present invention.
Figure 3A:
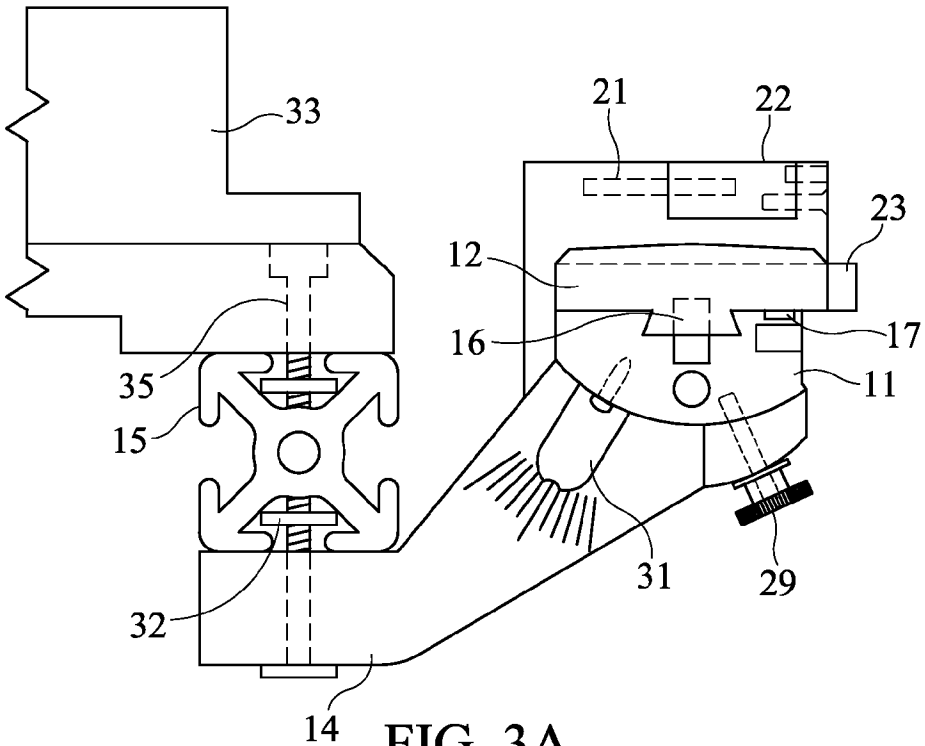
FIG. 3A shows a front view of a coping fixture according to the present invention.
Figure 3B:
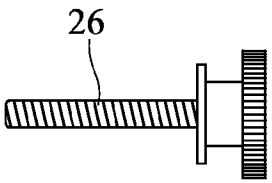
FIG. 3B shows another view of an aspect of the coping fixture of according to the present invention.

The present invention is a molding coping fixture. FIG. 1A shows a top view of a coping fixture according to the present invention. FIG. 2 shows a side view of a coping fixture according to the present invention. FIG. 3A shows a front view of a coping fixture according to the present invention. The various structures and components of a coping fixture according to the present invention can be explained in relation to their use during operation of the coping fixture.

To begin operation of a coping fixture according to the present invention, a sample section of the molding to be coped is needed. Preferably, this sample section is on the order of one inch in length. The sample section will be used to set the profile of the molding to be coped into the shims 13.

To set the profile into the shims 13, knob 20 is loosened and anti-tear-out fixture 22 is removed and shim set up platform 27 is installed. The shim set up platform pin 28 mates with a corresponding hole in the rotating dovetail block 11. When in place, shim set up platform 27 is under the sliding block 12 and the shims 13. On top of shim set up platform 27, there is a block that holds the outermost shim 13 in alignment with the sample section. Knob 19 is tightened to move the sliding block 12. This tightens all of the shims 13 by pulling on barrel nut 16 in the sliding block 12 via rod 24. Knob 19 can then be loosed slightly, allowing shims 13 to be moved until each shim 13 touches the sample section. Thus the shims 13 conform to the profile of the sample section.

Knob 19 can then be tightened to secure the shims 13. As sliding block 12 tightens against the shims 13, there may be some movement, or crush, of the shims 13. This crush may change the profile set into the shims. To minimize this crush effect, locking thumb screw 18 may be used to secure the shims 13. Preferably thumb screw 18 has a tip constructed from a material, such as TEFLON, that will not damage the shims 13. By using thumb screw 18 to tighten the shims 13, any crush in the shims 13 is taken up at the back end of the shims 13 and minimizes or eliminates any changes to the profile set into the shims 13.

In various preferred embodiments, a magnet 17 can be used to help hold the shims 13 in place. Preferably, the magnet 17 is recessed into the rotating dovetail block 11.

Once the profile is set and locked, the shim set up platform 27 is removed and the anti-tear-out fixture 22 is reinstalled. The anti-tear-out fixture 22 slides in an out on a guide pin 21. Guide pin 21 helps keep the anti-tear-out fixture 22 aligned with the adjacent shim 13. The anti-tear-out fixture is aligned such that the tip of the ramp 23 is aligned with the tip of the adjacent shim 13. In use, guide pin 49 (shown in FIG. 9, and explained further below) will ride along the profile set into the shims 13. When guide pin 49 rides up on the ramp 23, the operator can feel and or hear the difference in the cutting operation and the operator can pull the router bit away from the fixture. The anti-tear-out fixture can be secured in place with knob 20.

The molding to be coped can now be placed on top of the shims 13 and sliding block 12. The molding to be coped is aligned with the shim 13 nearest the anti-tear-out fixture 22, resting against the ant-tear out fixture 22. For a right-hand cope, the molding is placed face up. For a left-hand cope, the molding is placed face down.

As most walls do not meet at exactly right angles, either intentionally or because of natural variation, it is desirable to be able to adjust the coping cut accordingly. Cradle support arms 14 hold the rotating dovetail block 11. The rotating dovetail block is secured into the cradle support arms 14 with knobs 29. When knobs 29 are loosened, the rotating dovetail block 11 can be rotated to the desired angle for the coping cut. Since everything above the cradle support arms 14 can be attached to the rotating dovetail block 11, including the sliding block 12, the shims 13, the anti-tear-out fixture 22, and the router guide platform 25, these items rotate with the rotating dovetail block 11.

Rotating the rotating dovetail block 11 causes the router to make an angle cut at the end of the molding to be coped. A degree marker 31 can be attached to the rotating dovetail block 11. The degrees of rotation, left or right, can be marked on the cradle support arms 14. The rotating dovetail block 11 can be locked at the desired angle by tightening knobs 29.

Figure 4A:
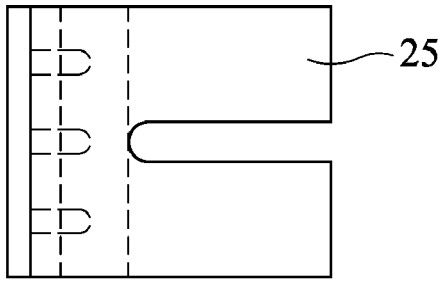
FIG. 4A shows a router guide platform as part of a coping fixture according to the present invention.
Figure 4B:
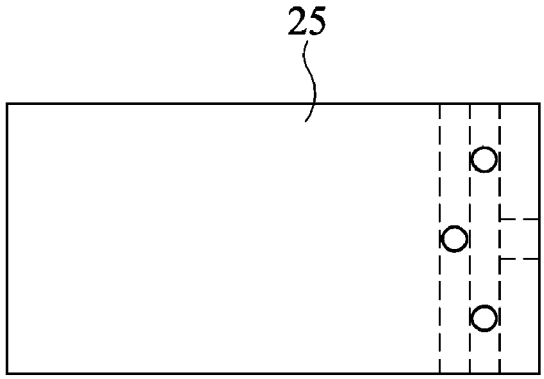
FIG. 4B shows another view of an aspect of the coping fixture of according to the present invention.
Figure 4C:
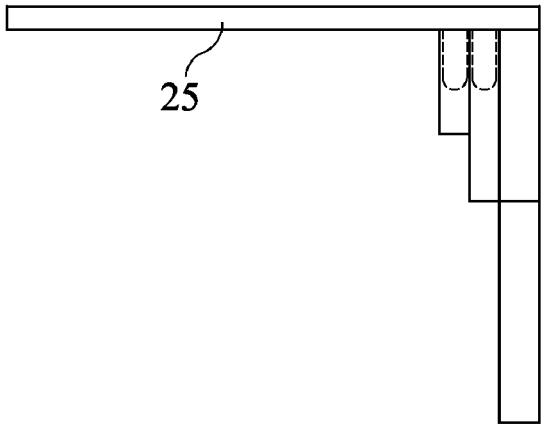
FIG. 4C shows another view of an aspect of the coping fixture of according to the present invention.
Figure 5A:
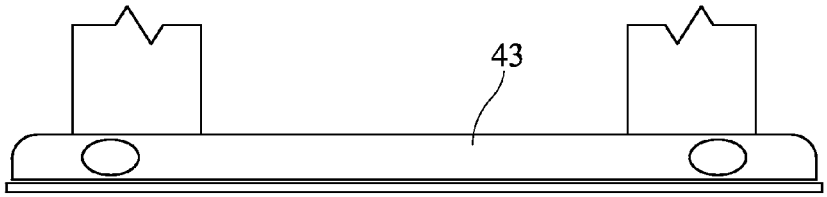
FIG. 5A shows an exploded view of a router mount plate as part of a coping fixture according to the present invention.
Figure 5B:
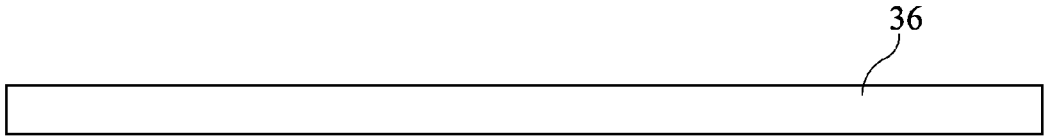
FIG. 5B shows another view of an aspect of the coping fixture of according to the present invention.
Figure 5C:
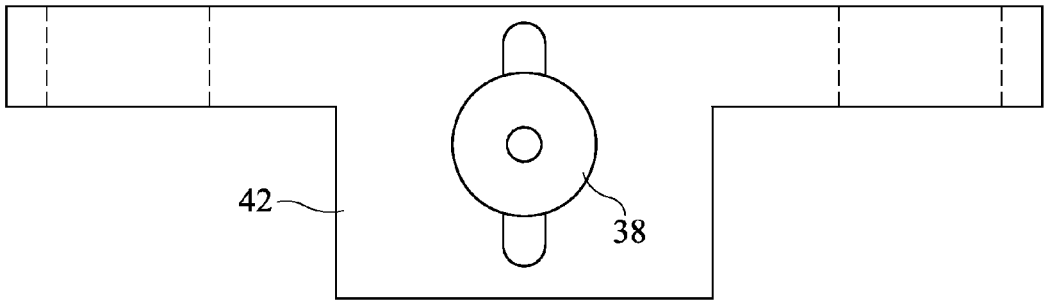
FIG. 5C shows another view of an aspect of the coping fixture of according to the present invention.
Figure 5D:
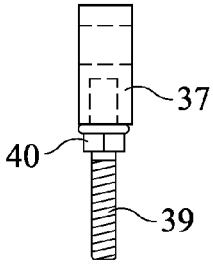
FIG. 5D shows another view of an aspect of the coping fixture of according to the present invention.
Figure 5E:
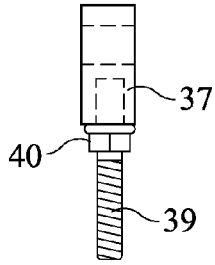
FIG. 5E shows another view of an aspect of the coping fixture of according to the present invention.

FIG. 4A shows a router guide platform as part of a coping fixture according to the present invention. Knob 26 is used to mount the router guide platform to the rotating dovetail block 11.

Figure 6:
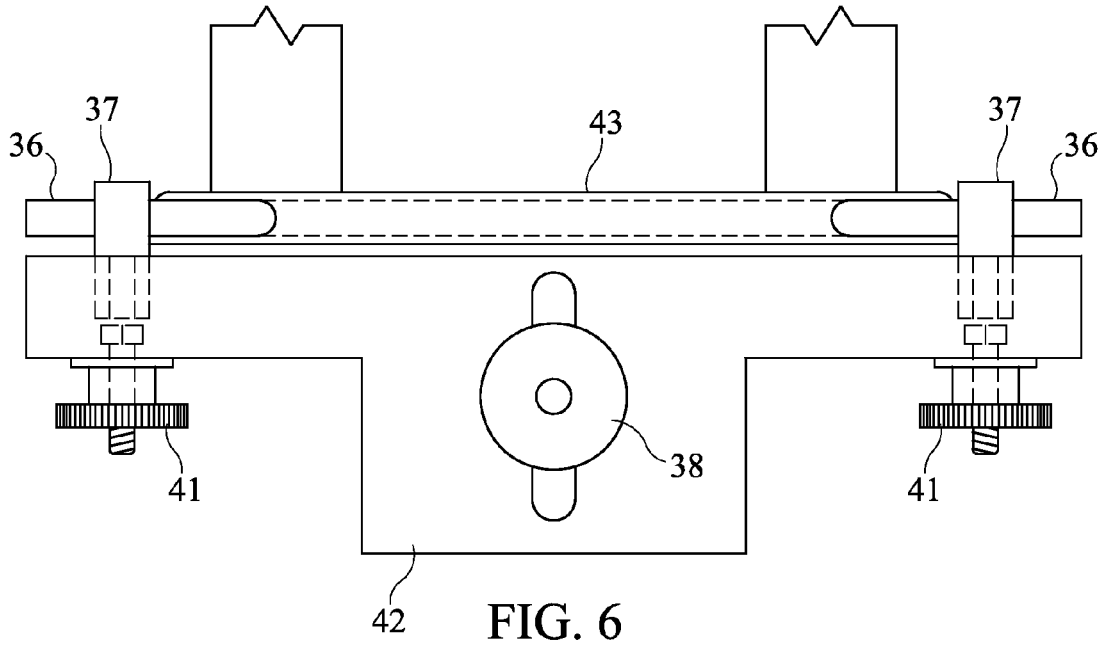
FIG. 6 shows an assembled view of a router mount plate as part of a coping fixture according to the present invention.

FIGS. 5A-E show an exploded view of a router mount plate as part of a coping fixture according to the present invention. FIG. 6 shows an assembled view of a router mount plate as part of a coping fixture according to the present invention. The router mount plate 42 attaches to the router base plate 43. The router mount plate 42 acts to hold guide pin 49 in alignment with the router bit. Use of guide pin 49 eliminates the need for a bearing to be attached to the router bit. Rod 36 secures the router mount plate 42 to the router base 43. Rod alignment and securing nuts 37 are shown as being square and fitted into a slotted rectangular cut into the router mount plate 42. When the rod alignment and securing nuts are secured with knobs 41, the rod 39 secures the router mount plate 42 to the router base 43.

Figure 7:
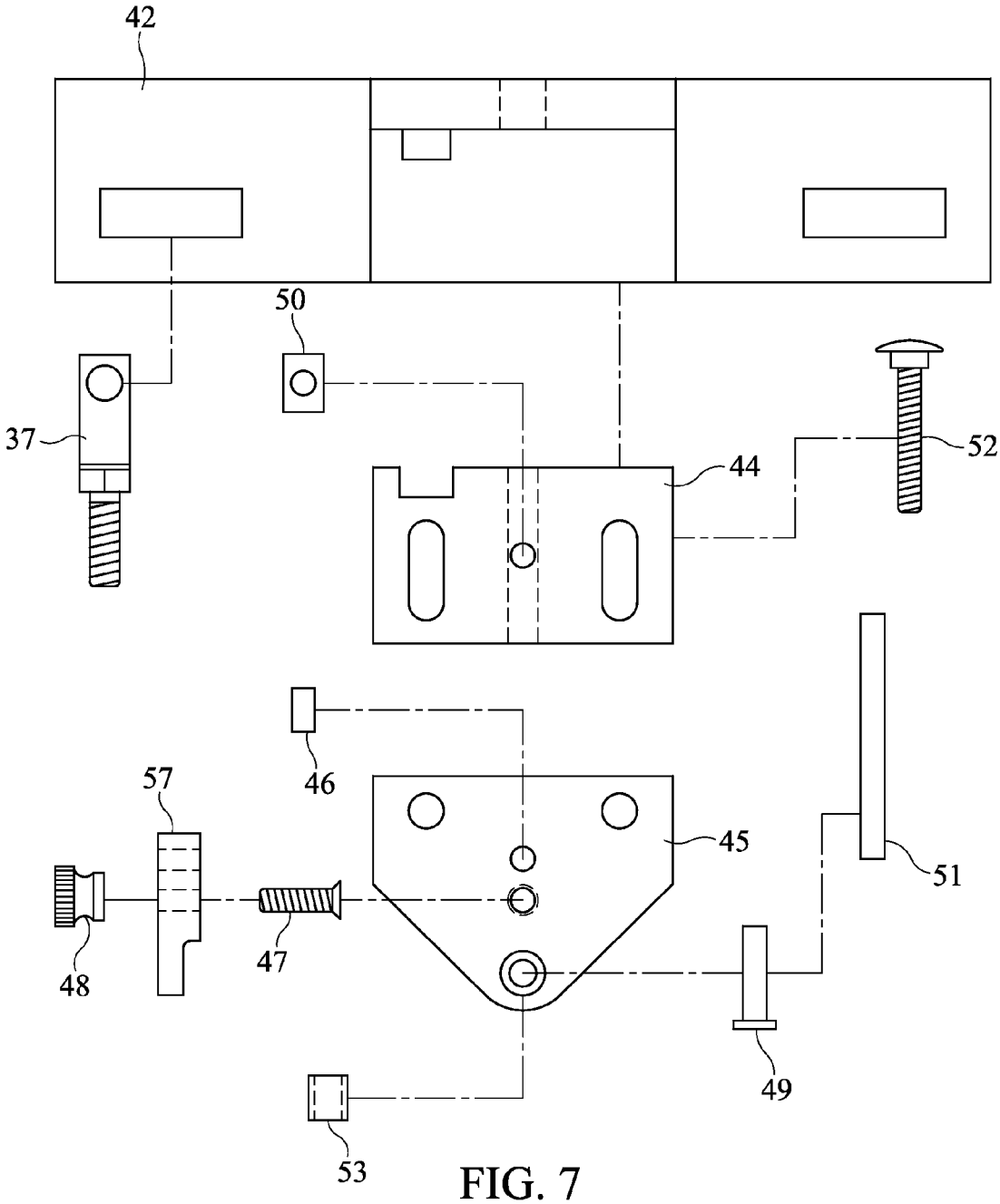
FIG. 7 shows a bottom exploded view of a router mount plate adapted to hold a guide pin in alignment with a cutting bit as part of a coping fixture according to the present invention.
Figure 8:
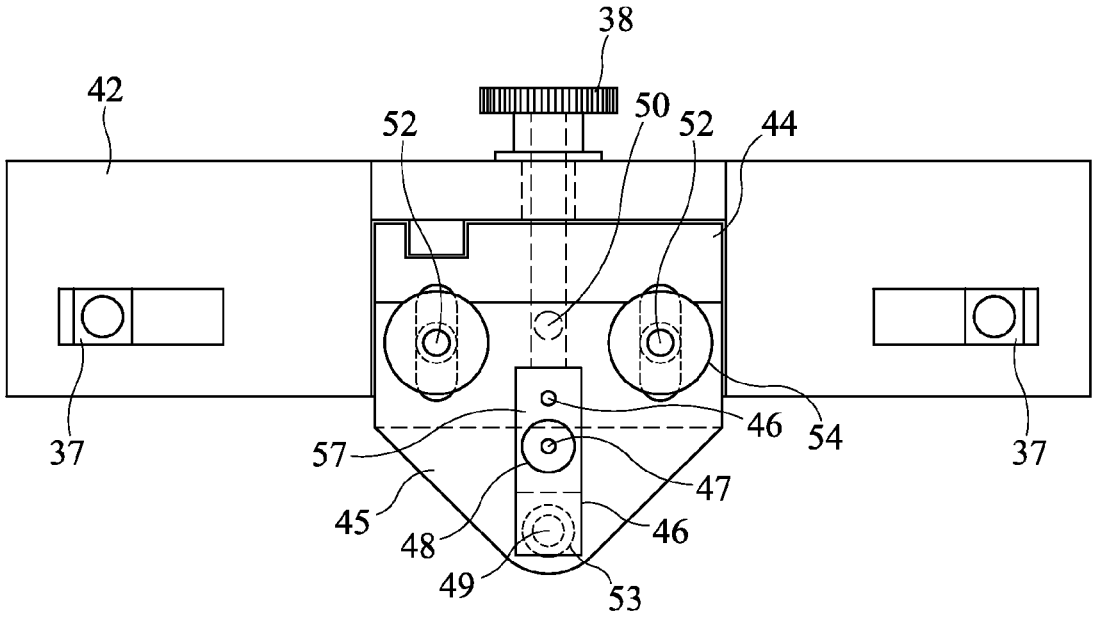
FIG. 8 shows a bottom assembled view of a router mount plate as shown unassembled in FIG. 7 as part of a coping fixture according to the present invention.

FIG. 7 shows a bottom exploded view of a router mount plate as part of a coping fixture according to the present invention. The figure is an unassembled view of what is shown in FIG. 8, and includes a router mount plate adapted to hold a guide pin in alignment with a cutting bit. FIG. 8 shows a bottom assembled view of a router mount plate as is shown unassembled in FIG. 7 as part of a coping fixture according to the present invention. Horizontal pin adjustment mount 44 moves in and out for horizontal movement of guide pin 49. The pin mount 45 allows for some lateral movement of guide pin 49. Different sizes of guide pins 49 may be used with different sizes of router bits. Smaller router bits provide for greater detailing in the coping cuts. The pin horizontal adjustment mount 44 and pin mount 45 are secured by carriage bolts 52 and locked together with locking knobs 54.

Guide pin 49 slides into pin bushing 53 and is held in place with pin hold 57. The pin hold 57 is secured by a small stud 47 and aligned by a small alignment pin 46. Thumb nut 48 holds the pin hold 57 securely in place.

Figure 9:
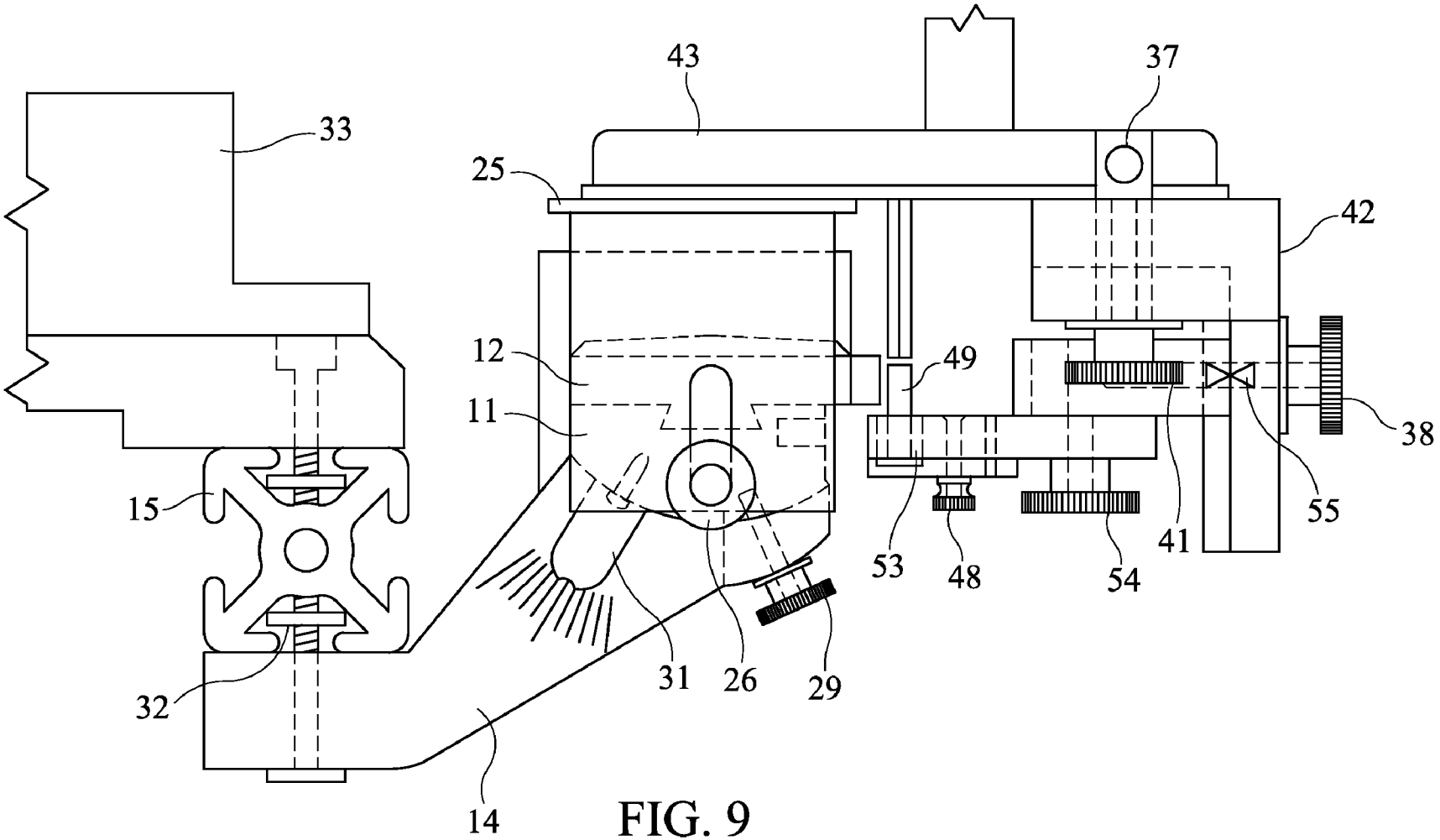
FIG. 9 shows a front view of a coping fixture according to the present invention.
Figure 10A:
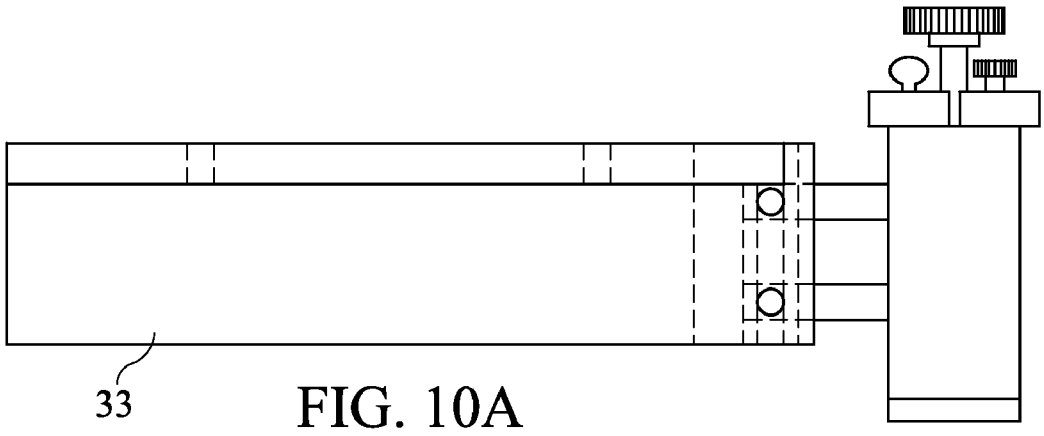
FIG. 10A shows front, top and side views of a work piece platform of a coping fixture according to the present invention.
Figure 10B:
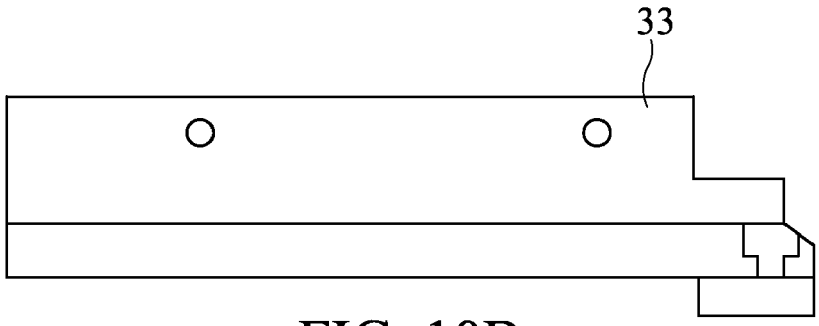
FIG. 10B shows another view of an aspect of the coping fixture of according to the present invention.
Figure 10C:
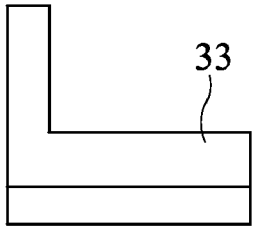
FIG. 10C shows another view of an aspect of the coping fixture of according to the present invention.
Figure 11A:
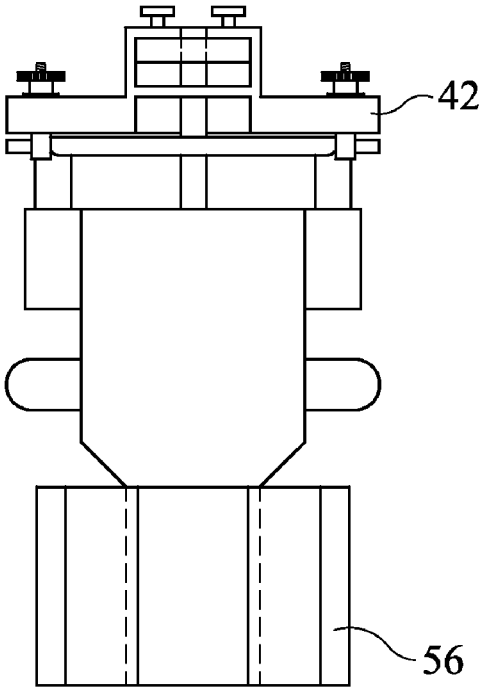
FIG. 11A shows top and side views of a router stand for use in conjunction with a coping fixture according to the present invention.
Figure 11B:
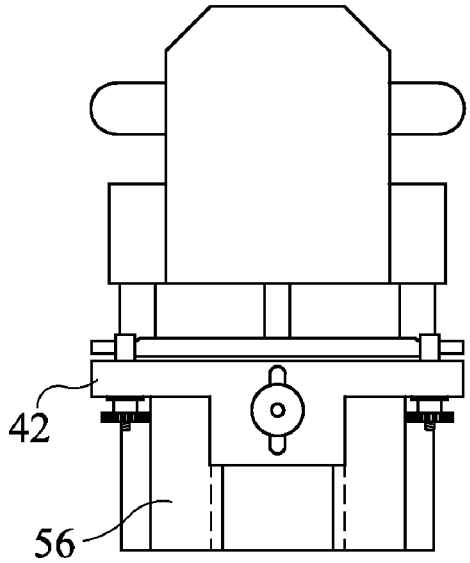
FIG. 11B shows another view of an aspect of the coping fixture of according to the present invention.
Figure 11C:
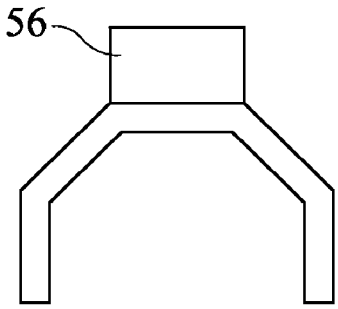
FIG. 11C shows another view of an aspect of the coping fixture of according to the present invention.
Figure 11D:
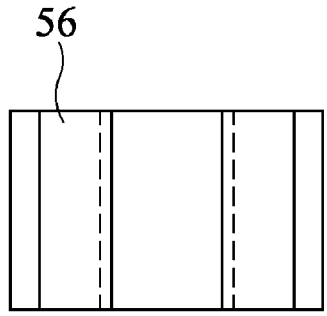
FIG. 11D shows another view of an aspect of the coping fixture of according to the present invention.

FIGS. 10A-C show front, top and side views of a work piece platform of a coping fixture according to the present invention. The molding to be coped is held in place by being clamped to a work piece platform 33. The work piece platform 33 can be secured, either bolted or clamped or the like, to a compound miter saw or other object as desired by the operator. FIG. 9 shows a front view of a coping fixture according to the present invention. Alternatively, mount 15 may be connected to the side of a compound miter saw or the like. Mount 15 may be provided with T-slots for this purpose. If mount 15 is connected to a miter saw or other object, work piece platform 33 may be eliminated.

FIGS. 11A-D show top and side views of a router stand for use in conjunction with a coping fixture according to the present invention. A router stand 56 can be used to help make the adjustments to the router mount plate 42 and guide pin 49. For example, the router may be placed upside down (router base up) in the router stand 56 while the adjustments are being made. After the settings are complete, the router can rest, right side up, in the router stand 56.

Special note may be made that the router mount 42, having guide pin 49, may also be used independently of the coping fixture as a scroll saw or similar cutting apparatus. Guide pin 49 is suitable for following any template.

Figure 12A:
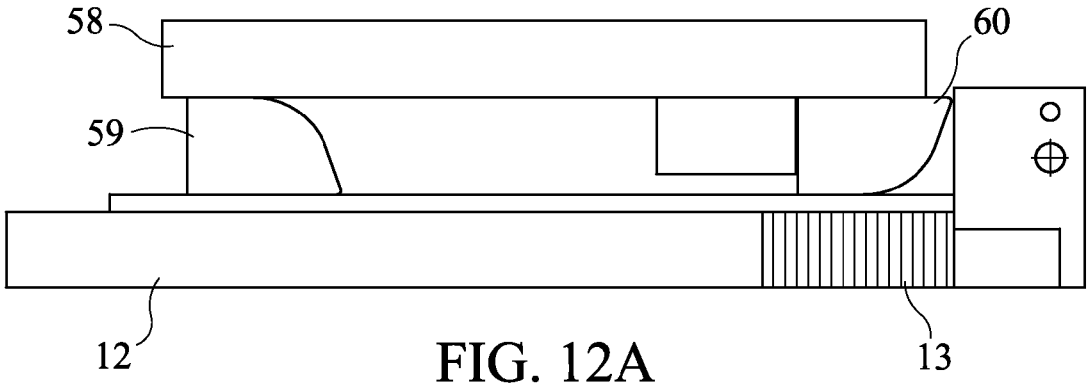
FIG. 12A shows top and side views of a quarter round holding fixture for use in conjunction with a coping fixture according to the present invention.
Figure 12B:
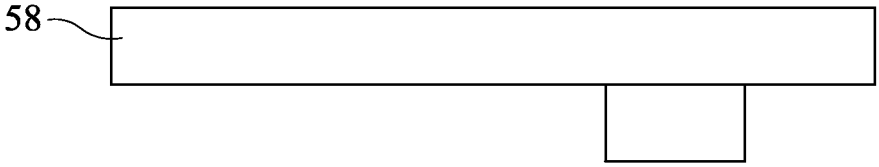
FIG. 12B shows another view of an aspect of the coping fixture of according to the present invention.
Figure 12C:
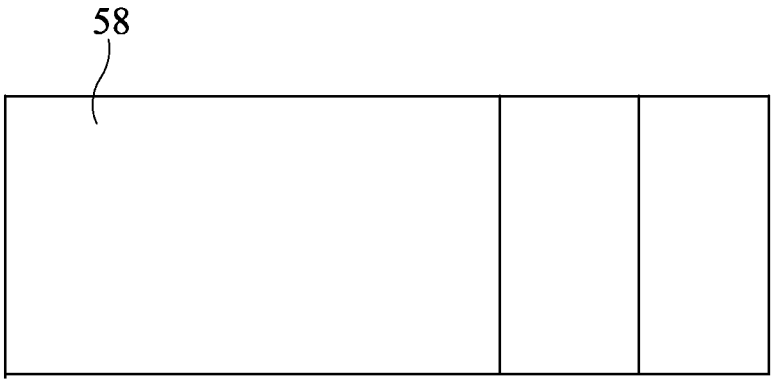
FIG. 12C shows another view of an aspect of the coping fixture of according to the present invention.

In addition to coping moldings, the coping fixture described above may also be used to cope quarter round in much the same way. The settings of the shims 13 and the shim set-up platform 27 are accomplished in the same manner as described above. However, for quarter round, a hold down fixture 58 is needed. FIGS. 12A-C show top and side views of a quarter round holding fixture for use in conjunction with a coping fixture according to the present invention. A small sample of quarter round is used to set the profile of the quarter round into the shims 13. This same sample piece of quarter round is then used as a spacer 59 in the quarter round holding fixture 58. The other end of the quarter round holding fixture 58 has a block attached to it that pushed the work piece quarter round (the piece being coped) against the fence. A C-clamp can be used to hold the quarter round holding fixture 58 down so the coping cut may be made.

Figure 13A:
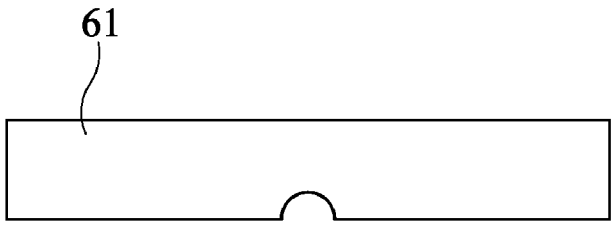
FIG. 13A shows top, side, and front views of a height gauge for use in conjunction with a coping fixture according to the present invention.
Figure 13B:
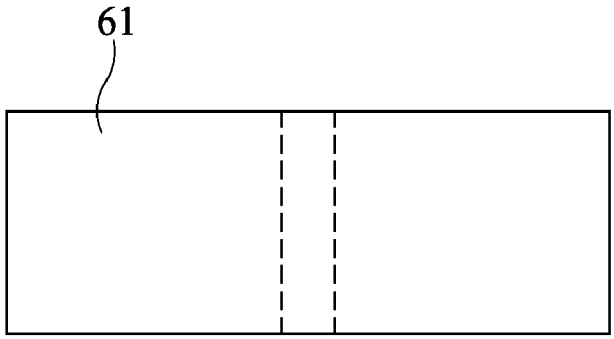
FIG. 13B shows another view of an aspect of the coping fixture of according to the present invention.
Figure 13C:
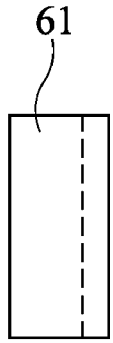
FIG. 13C shows another view of an aspect of the coping fixture of according to the present invention.
Figure 14A:
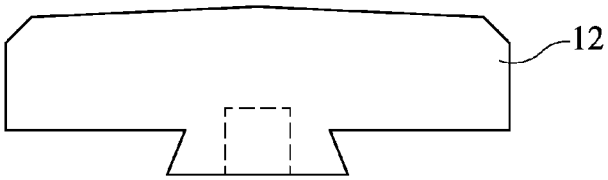
FIG. 14A shows side and bottom views of a sliding block and sliding block rod of a coping fixture according to the present invention.
Figure 14B:
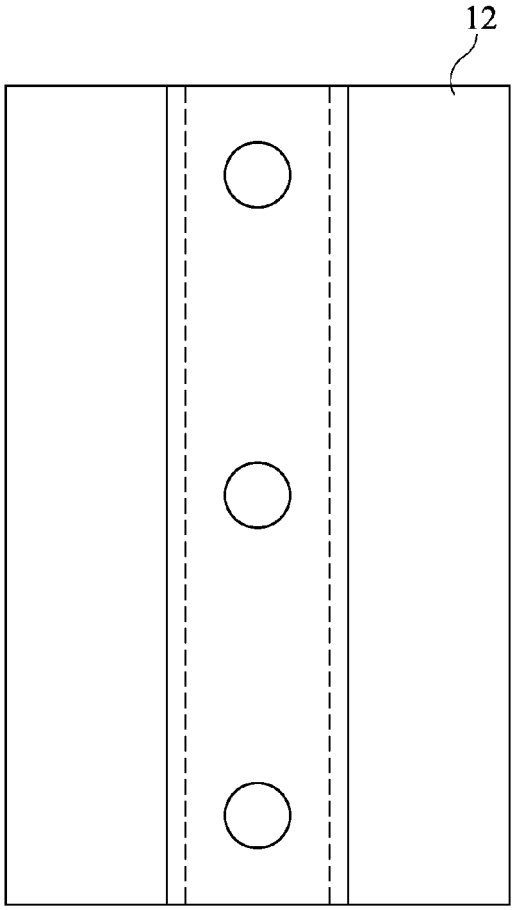
FIG. 14B shows another view of an aspect of the coping fixture of according to the present invention.
Figure 14C:
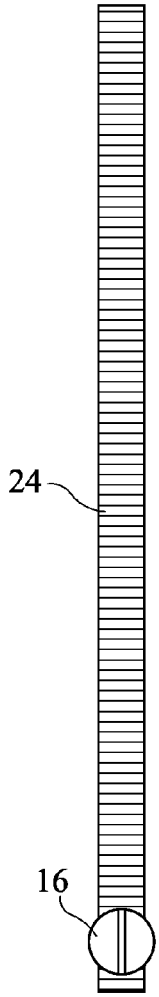
FIG. 14C shows another view of an aspect of the coping fixture of according to the present invention.
Figure 14D:
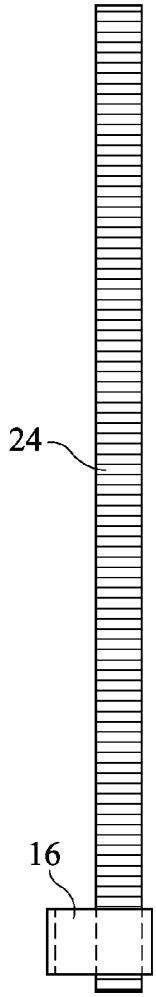
FIG. 14D shows another view of an aspect of the coping fixture of according to the present invention.

FIGS. 13A-C show top, side, and front views of a height gauge for use in conjunction with a coping fixture according to the present invention. A height gauge 61 is used to set the height of the router bit when installed in the router. Since the coping fixture of the present invention incorporates a router guide platform 25 with a fixed height over the tool, the router bit will always extend a fixed amount. This fixed height remains the same, independent of what molding is being coped. Accordingly, since the height will remain the same, height gauge 61 may be used for quick and easy setup of the router bit height. A second function of the height gauge 61 is to align the guide pin 49 with the router bit. A groove cut into the height gauge 61 is pressed against the alignment pin 51, which is temporarily installed in the router. When the guide pin 49 is aligned in the same groove, the guide pin 49 and the router bit are in alignment.

To set the vertical height of the guide pin 49, two alignment markers 55 are used. One marker 55 is on the router mount 42. The other marker 55 is on the horizontal mount 44. When these two markers 55 point toward each other, the guide pin 49 is at the correct vertical height and will follow the sliding block 12 and the shims 13 as needed.

Friction tape can be used to help secure the various components together and help prevent them from slipping during operation of the coping fixture. For example, friction tape can be applied to the top of the router mount plate 42 to help secure the router base 43 in place. Friction tape may also be used on the pin horizontal mount 44 to help secure the pin mount 45 in place.

FIGS. 14A-D show side and bottom views of a sliding block and sliding block rod of a coping fixture according to the present invention. Point A on the slide block 12 indicates the point of the sliding block 12 that supports the molding being coped. Adjustable holes are located in the bottom of the sliding block. A barrel nut 16 is attached to the sliding block rod 24. The barrel nut 16 is offset from the rod 24, the offset portion of the barrel nut 16 is inserted into one of the holes. The different holes permit the sliding block rod 24 to accommodate moldings of different sizes.

Figure 15A:
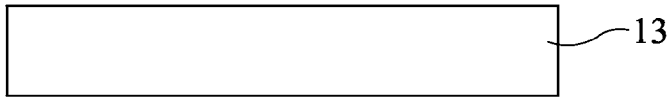
FIG. 15A shows side and top views of a shim for use in a coping fixture according to the present invention.
Figure 15B:
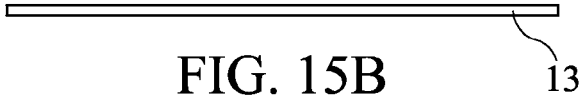
FIG. 15B shows another view of an aspect of the coping fixture of according to the present invention.
Figure 16A:
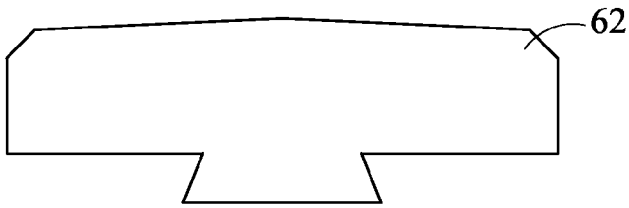
FIG. 16A shows an extension block of a coping fixture according to the present invention.
Figure 16B:
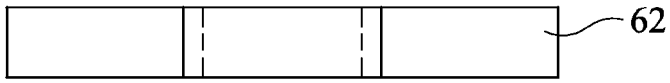
FIG. 16B shows another view of an aspect of the coping fixture of according to the present invention.

FIGS. 15A-B show side and top views of a shim for use in a coping fixture according to the present invention. The shims 13 as shown are rectangular sections of material, preferably metal. FIGS. 16A-B show an extension block of a coping fixture according to the present invention. The extension block 62 can be used between shims 13 to fill places where curved profiles are not need in the molding to be coped.

Figure 17A:
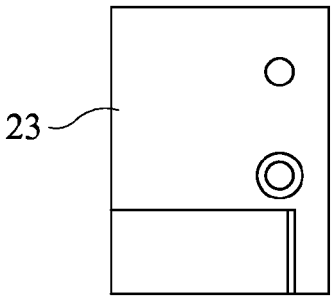
FIG. 17A shows an anti-tear-out ramp of a coping fixture according to the present invention.
Figure 17B:
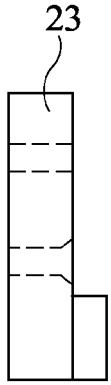
FIG. 17B shows another view of an aspect of the coping fixture of according to the present invention.
Figure 17C:
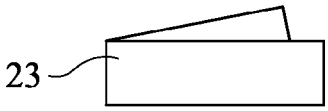
FIG. 17C shows another view of an aspect of the coping fixture of according to the present invention.

FIGS. 17A-C show an anti-tear-out ramp of a coping fixture according to the present invention. The anti-tear-out ramp 23 can be a replaceable portion of the anti-tear-out fixture 22. Since the top portion of the anti-tear-out ramp is close to (and in some instances, may come into contact with) the router bit performing the coping cut, the top portion of the anti-tear-out ramp 23 may become worn over time. In various preferred embodiments, the anti-tear-out ramp 23 has two holes in it. One hole is for an alignment pin. The other hole can be used for a screw or other fastening device to secure the anti-tear-out ramp 23 to the anti-tear-out fixture.

While specific embodiments have been illustrated and described, numerous modifications come to mind without significantly departing from the spirit of the invention and the scope of protection is limited by the scope of the accompanying claims.

What is claimed is:

1. A coping fixture comprising:

a work piece platform adapted to receive a piece of molding to be worked upon, a shim mounting structure operatively connected to said work piece platform, a plurality of shims, each of said shims having two elongated side surfaces, said shims mounted to said shim mounting structure, wherein said shims are positioned with opposing ones of said elongated side surfaces facing one another, said shims slidably adjustable to conform to an edge profile of a molding to be coped, wherein said shims being slidably adjustable comprises said shims being transversely slidable with respect to one another relative to adjacent surfaces of said shims, means for securing said shims with respect to said shim mounting structure and adapted to maintain said profile during a coping cut.

2. The coping fixture according to claim 1, further comprising an anti-tear-out fixture fixedly mounted with respect to said shim mounting structure and adapted to prevent tear-out of material from such a molding during such a coping cut.

3. The coping fixture according to claim 1, further comprising means for selectively adjusting the angle of said plurality of shims, coupled to said shim mounting structure, to enable an adjusted cut angle to be formed when a coping cut is made with a router.

4. A coping fixture comprising:

a shim mounting structure, a plurality of shims mounted to said shim mounting structure, said shims slidably adjustable to conform to an edge profile of a molding to be coped, means for securing said shims with respect to said shim mounting structure and adapted to maintain said profile during a coping cut, further comprising a router disposed in operative relation to the shim mounting structure having a router bit and a guide pin, said guide pin adapted to pass along said shims during a coping cut of an edge of the molding to be coped, and said router bit secured in a fixed relation to said guide pin adapted to perform said coping cut while said guide pin passes along said shims.

5. The coping fixture according to claim 1, wherein said shim mounting structure comprises a sliding block and a rotating block, and wherein said means for securing said shims into said shim mounting structure and maintaining said edge profile during a coping cut by a router comprises:

said sliding block slidably mounted on said rotating block, wherein said rotating block is rotatably mounted to a cradle support arm, said cradle support arm being fixedly mounted with respect to said work piece platform, said rotating block having at least one dovetail slot disposed thereon, said sliding block having at least one dovetail track formed therein for operatively engaging said at least one dovetail slot, and means for tightening said sliding block against said shims.

6. The coping fixture according to claim 2, wherein said anti-tear-out means comprises an anti-tear-out ramp adapted to be mounted against a top edge of such a molding and next to a last shim in said plurality of shims.

7. The coping fixture according to claim 1, wherein said fixture further comprises means for holding down such a molding during such a coping cut to said work piece platform, said means for holding down operatively mounted to said work piece platform.

* * * * *